US006123618A

United States Patent [19]

Day

[11] Patent Number: 6,123,618

[45] Date of Patent: Sep. 26, 2000

[54] AIR MOVEMENT APPARATUS

[75] Inventor: Terence Robert Day, Coombabah, Australia

[73] Assignee: Jetfan Australia Pty. Ltd., Queensland, Australia

[21] Appl. No.: 09/256,179

[22] Filed: Feb. 24, 1999

Related U.S. Application Data

[63] Continuation of application No. 08/875,401, Jul. 31, 1997, abandoned.

[51] Int. Cl.[7] ..... F24F 7/007

[52] U.S. Cl. ..... 454/230

[58] Field of Search ..... 454/230, 231, 454/228, 234

[56] References Cited

U.S. PATENT DOCUMENTS

| | | | |
|---|---|---|---|
| 2,583,374 | 2/1952 | Hoffman | 454/230 |
| 2,617,348 | 11/1952 | Sutton . | |
| 2,640,646 | 6/1953 | Jones . | |
| 5,203,521 | 4/1993 | Day . | |

FOREIGN PATENT DOCUMENTS

| | | | |
|---|---|---|---|
| 1095114 | 5/1955 | France . | |
| 7158587 | 10/1993 | Japan | 454/230 |

OTHER PUBLICATIONS

Patent Abstracts of Japan, JP 7158587 A (Shibaura Eng Works Co Ltd) Jun. 20, 1995.

Derwent Abstract Accession No. B7147 E/07, Clas Q56, SU 821752 A (Azov Black Sea Agri) Apr. 18, 1981.

Derwent Abstract Accession No. C8055 D/13, Class Q12, SU 748032 A (Omnibus Cons Exper) Jul. 25, 1980.

*Primary Examiner*—Harold Joyce
*Assistant Examiner*—Derek S. Boles
*Attorney, Agent, or Firm*—Hoffman, Wasson & Gitler

[57] ABSTRACT

An air movement apparatus (10) comprises a curved body about which air can circulate, the curved body having a rim (12) and, in use, having a lower pressure surface (25) on one side of the rim (12), and a higher pressure surface (26) on the other side of the rim (12), an air outlet (22) to blow air over the lower pressure surface (25), an air inlet (24) to suck air in from the higher pressure surface (26), and air acceleration means (14) to move air from the air inlet (24) to the air outlet (22).

12 Claims, 2 Drawing Sheets

AIR MOVEMENT APPARATUS

This is a continuation of Ser. No. 08/875,401, filed Jul. 31, 1997, now abandoned.

FIELD OF THE INVENTION

This invention relates to an air movement apparatus which can include ceiling fans, wall fans, ventilating devices such as exhaust fans, and the like, and where the apparatus does not have externally rotating blades.

BACKGROUND ART

Air movement devices such as ceiling fans, extractor fans and the like, conventionally have a number of extending fan blades which rotate at varying speeds. The fan blades radiate from a central hub portion and the hub is connected to a shaft which is driven by an electric motor.

These fans suffer from two main disadvantages. Firstly, ceiling fans are dangerous because of the circulating metallic fan blades. There are numerous cases of injury to children which come into contact with the fan blades. Similarly, children have been injured by inserting fingers into wall fans.

The second main disadvantage with these fans is that they suck air from an area immediately above the blades. That is, air is not drawn directly into the blades and therefore moved by the blades from positions other than immediately above the blades. This lack of efficiency is particularly problematic with exhaust fans positioned above stoves. Typically, these exhaust fans only exhaust a small portion of air directly below the fan but do not readily draw air in from any other position.

Additionally, it is difficult to provide heating or cooling devices in association with large bladed fans as such an arrangement is extremely inefficient. Providing a smaller bladed fan (such as that found with small fan heaters), is also not efficient as the volume of the moved air is low, and the smaller fans are extremely localised.

Another disadvantage with ceiling fans is that by their design they are not suitable, and indeed can be extremely dangerous when attached to low ceilings as it is common for a conventional ceiling fan to be spaced from a ceiling by up to 50 cm.

OBJECT OF THE INVENTION

It is an object of the invention to provide an air mover which may overcome the abovementioned disadvantages or provide a useful or commercial choice.

In one form, the invention resides in an air movement apparatus comprising a curved body about which air can circulate, the curved body having a rim and, in use, having a lower pressure surface on one side of the rim, and a higher pressure surface on the other side of the rim, an air outlet to blow air over the lower pressure surface, an air inlet to suck air in from the higher pressure surface, and air acceleration means to move air from the air inlet to the air outlet.

By having this arrangement, air is circulated around the curved body and the air acceleration means functions to keep the air moving about the curved body. On the lower pressure surface, the circulating air will entrain adjacent air, and when the entrained air passes over the high pressure surface, the entrained air will be ejected downwardly to provide the air movement. Thus, a portion of the air circulates about the body and this portion entrains and ejects adjacent air to provide the air movement effect. Thus, it can be seen that the apparatus does not have external moving blades which can injure children. The apparatus can be quite compact in shape making it useful for smaller dwellings having a lower ceiling, and it is also noted that air is entrained along the lower pressure surface and not only at a position immediately above the apparatus.

It is preferred that the curved body is toroidal in configuration. That is, the curved body can have a doughnut-type shape. The toroidal body need not be circular in cross-section, and the particular shape of the toroidal body may be varied depending on a number of factors these factors including the speed of air circulating around the body and tile volume of air desired to be moved. It is preferred that the cross-section of the toroidal body is of a design which is flattened along the lower pressure surface. The toroidal body has a rim with the lower pressure surface being on one side of the rim and the higher pressure surface being on the other side of the rim (it being appreciated that the pressures will only be effected when air is circulated about the toroidal body).

The toroidal body may be formed from various suitable materials such as metal, plastic and composites. The toroidal body may be entirely solid or hollow. The toroidal body may be formed from opaque or clear material. A illuminating device may be positioned within the toroidal body and in this embodiment, the toroidal body may be made from clear material, or a portion of the toroidal body may be formed from clear material to allow light to pass therethrough.

The air outlet may comprise a single outlet or a number of spaced outlets. Preferably, the air outlet is a single outlet. The outlet can be positioned adjacent one end of the central passageway which extends through the toroidal body. This end of the passageway is the one which communicates with the lower pressure surface such that air passes through the outlet and over the lower pressure surface. If the body is toroidal, the air outlet may comprise an annular slot.

The air inlet may comprise the other end of the central passageway defined by the toroid.

A first barrier member may be provided adjacent the said one end of the central passageway. The first barrier member may have a peripheral edge spaced from the body to define the annular opening of the air outlet. The barrier member may have a portion which extends at least partially into the central passageway. This portion may have a configuration to facilitate movement of air through the central passageway and through the air outlet. In one form, the portion may be cone-like in shape.

The first barrier member may be attached to a shaft. The barrier member may be alidingly attached to the shaft such that it can "float" above the central passageway. Thus, the size of the air outlet can vary depending on the position of the first barrier member, and if the first barrier member is allowed to "float", the size of the air outlet can vary depending on the volume and velocity of air passing through the air outlet.

The air acceleration means may comprise a bladed fan. The bladed fan may comprise a hub and a number of extending blades. Suitably, the blades at least are located entirely within the central passageway. The blades may be attached to the hub and the hub may comprise the portion of the barrier member which extends into the central passageway. In this embodiment, the shaft may be coupled to a motor and turned to turn the first barrier member and therefore the blades.

In another embodiment, the first barrier member may be non-rotatably mounted and the air acceleration means may comprise a bladed fan which is mounted for rotation relative to the first barrier member.

The bladed fan may be of any suitable type and may include an axial fan, a centrifugal fan, or a mixed flow fan.

A second barrier member may be positioned adjacent the other end of the central passageway. The second barrier member may be plate-like, mesh-like, gridlike and may function to prevent fingers from being inserted into the central passageway.

In order to facilitate movement of air around the body, it is desirable to ensure that the air is turbulent. thus, as air exits from the air outlet, it is preferred that the air is cause to bend and roll into a vortex. This can be assisted by having a recess or step formed in the body and adjacent the air outlet. The recess or step can cause the air jet to entrain and evacuate the air under itself which can cause the air jet to bend and roll into a vortex. The recess or step preferably extends the length of the air outlet. Thus, if the air outlet is annular, it is preferred that the recess or step is also annular.

If desired, the apparatus may include a heater to heat air. The heater may comprise a heating element. The heating element may be positioned in the central passageway to heat air as it passes through the passageway. If the heater is positioned in the central passageway, it is preferred that the second barrier member is provided to prevent inadvertent touching of the heater. Similarly, cooling means such as cooling coils may be provided. The cooling means may also be located in the central passageway to cool air as it passes along the passageway.

It is found that air is entrained on the lower pressure surface as air passing through the air outlet travels around the curved body. To facilitate entrainment of air in the vicinity of the air outlet and an upper portion of the lower pressure surface, and also to facilitate ejection of air at desired positions, the apparatus may be associated with a shroud. If the curved body is a toroid, the shroud may comprise an annular band which extends about the toroid and generally about the rim area of the toroid. The spacing between the shroud and the outer surface of the body may vary, but the spacing may approximate the diameter of the vortices. The shroud may form part of the apparatus. Alternatively, the apparatus may be mounted in an opening in a wall or ceiling, with the walls of the opening able to function as the shroud.

BRIEF DESCRIPTION OF THE DRAWINGS

An embodiment of the invention will be described and illustrated with reference to the accompanying drawings in which

Referring to the figures, FIG. 1 shows a curved body of an air movement apparatus 10. The curved body is in the shape of a toroid having a central passageway 11 and an outer rim 12. FIGS. 1 to 4 also show an annular recess or step 13 in body 10 the function of which will be described in greater detail with reference to FIGS. 5 and 6. Body 10 may be formed from any desirable material such as expanded plastics, other plastics or metal. Body 10 may be entirely solid, entirely hollow, or partially solid and partially hollow. The width and height of body 10 can vary to suit from very large sizes to very small sizes.

FIG. 2 shows an air acceleration means in the form of a bladed fan 14 having a central hub 15 and a number of spaced overlapping blades 16. Bladed fan 14 has a shaft 18 attached to motor 17 which can drive fan 14.

As illustrated in FIG. 3, the upper portion of central passageway 11 is partially closed with a first barrier member 19. First barrier member 19 overlies the upper portion of central passageway 11. The first barrier member has a portion 20 which extends into the central passageway 11. It can be seen that the first barrier member is frusto-conical in configuration. The peripheral edge 21 of first barrier member 19 is spaced inwardly from the outer wall of body 10 to define an annular blowing slot 22 which forms the air outlet. The top of barrier member 19 has a post 23 to attach it to a ceiling or other support.

Referring to FIGS. 5 and 6, there are shown cross-section views of the air movement apparatus. FIG. 5 better illustrates the annular blowing slot 22, the position of fan 14, and blades 16. FIGS. 5 and 6 also illustrate the cross-section shape of body 10 and it can be seen that the cross-section shape is slightly flattened on a bottom portion.

Referring to FIGS. 5 and 6, annular blowing slot 22 blows high speed air onto curved body 10. The air follows the curvature of body 10 and passes along body 10 from blowing slot 22 past rim 12 and back into the central passageway 11 through inlet 24. The upper part 25 of body 10 (that is the part between blowing slot 22 and rim 12), can be seen as a lower pressure surface, as air blowing through slot 22 passes over body 10 and the surface area of body 10 increases thereby lowering the air pressure. By lowering the air pressure, adjacent ambient air is entrained or mixed with the air passing over the lower pressure surface 25. As the air passes past rim 12 and begins to move back into central passageway 11, the surface area that the air moves along, decreases or converges and this part of body 10 can be seen as the higher pressure surface 26. As the pressure increases, the entrained or mixed air is ejected from the circulating air flow and at a position below the apparatus.

Figure 1:
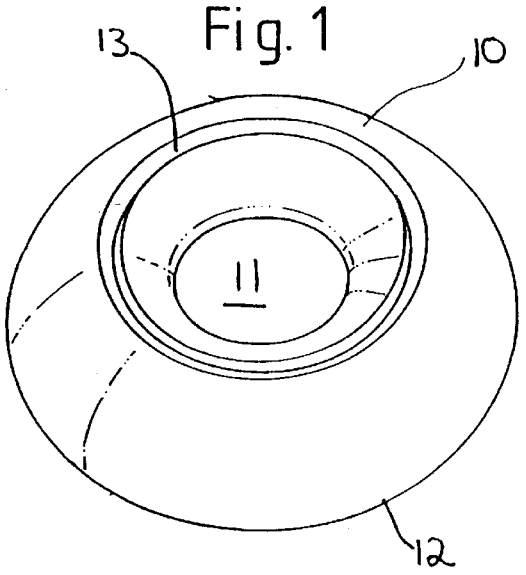
FIG. 1 shows a curved body of an air movement apparatus according to an embodiment of the invention.
Figure 2:
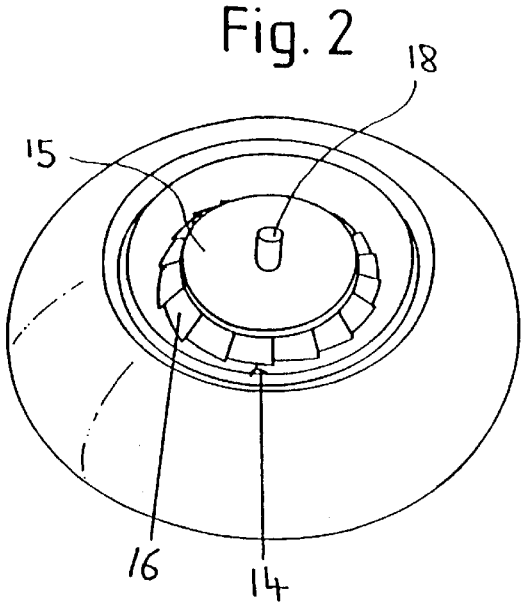
FIG. 2 shows the body of FIG. 1 with an air acceleration means positioned within the body.
Figure 3:
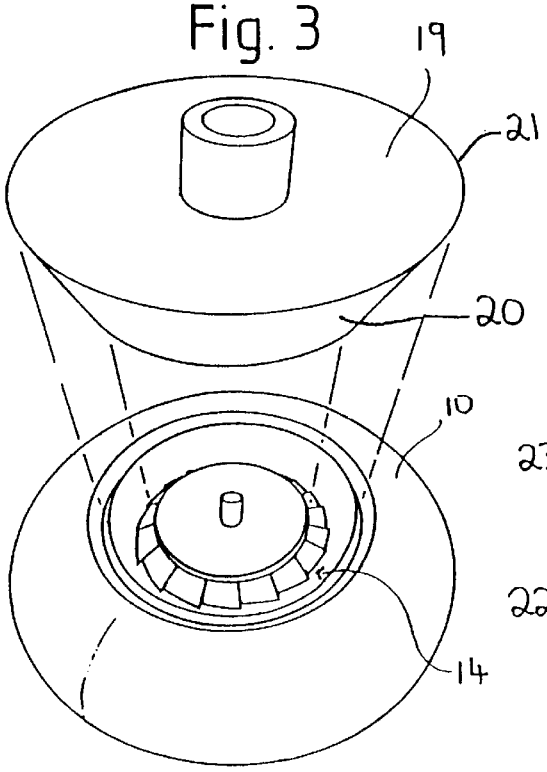
FIG. 3 shows the apparatus of FIG. 2 and including a first barrier member.
Figure 4:
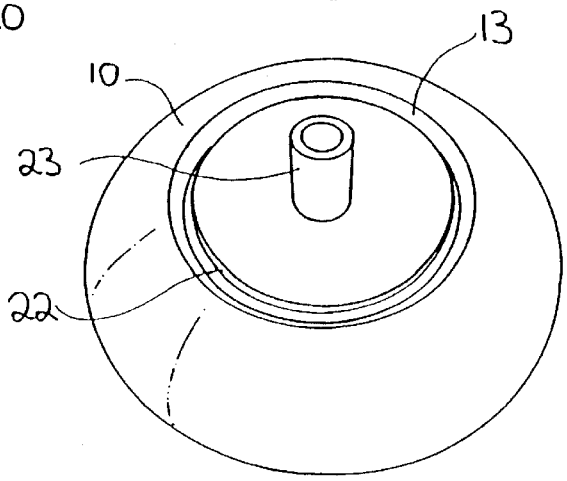
FIG. 4 is an upper view of the assembled apparatus of FIGS. 1, 2 and 3.

It is found that the movement of air about the body 10 can be facilitated by introducing turbulence such as vortices. This turbulence can be introduced by providing a roughened surface to body 10. Additionally, the annular recess or step) 13 also functions to form turbulence. As the high speed jet of air rushes over recess or step 13, it entrains and evacuates the air under itself. This causes the jet to bend and roll into a vortex at the beginning of an upper part or shoulder 27 of the lower pressure surface 25. This is called a ring vortex as it rings the top side of body 10. If the jet is high speed, several of these vortices form and spin outwardly over shoulder 27.

The rotating air is of lower pressure than ambient air due to its speed. Adjacent ambient air is entrained into the vortices which grow in diameter as they travel outwardly. The vortices, due to their low pressure, also follow the curved surface of body 10 and roll around the body to the underside 26. Once the vortices pass rim 12, they cannot remain attached to the underside of body 10 for much distance, as because the vortices are travelling along a decreasing surface area, the pressure rises. The higher pressure causes the air to be ejected out and down.

A portion of the air is however passed into central passageway 11 and circulated or re-circulated about body 10.

A second barrier member in the form of plate, grill, mesh and the like 28 can be positioned adjacent inlet 24. The function of plate 28 is primarily to prevent fingers being inserted into central passageway 11, although plate 28 may also function to facilitate in defining the shape and size of inlet 24.

The toroidal body may be hollow and may include internal lights 29. These lights may be in the form of circular fluorescent lights. If lights are positioned within body 10, it is preferred that body 10 is either made entirely of clear material, or that at least a lower portion of body 10 is formed of clear material.

Inside central passageway 11 may be positioned a heating element 35 to heat air as it passes along the passageway. Alternatively or additionally, a cooling coil or other type of cooling means may be positioned within the central passageway.

First barrier member 19 may be slidably attached to post 23 or may be otherwise slidingly attached such that it can move up and down to increase or decrease the size of annular blowing slot 22. Barrier member 19 may "float" above body 10 and it is found that barrier member 19 self regulates the size of the annular blowing slot depending primarily on the volume and velocity of air passing therethrough. Although not wishing to be bound by theory, it appears that if the annular blowing slot is too large for the volume and velocity of air passing therethrough, some turbulating air may pass back into the passageway through the blowing slot which is undesirable. By having the barrier member "floating", it can automatically tune the annular blowing slot to the correct size.

Figure 5:
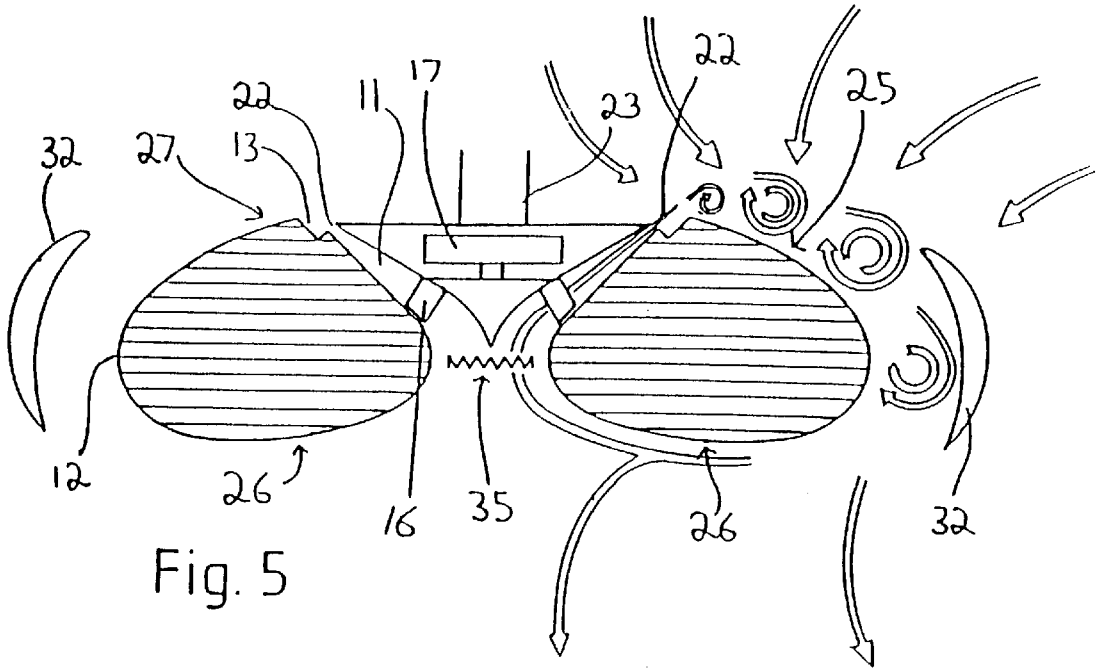
FIG. 5 is a side section view of an air movement apparatus.
Figure 6:
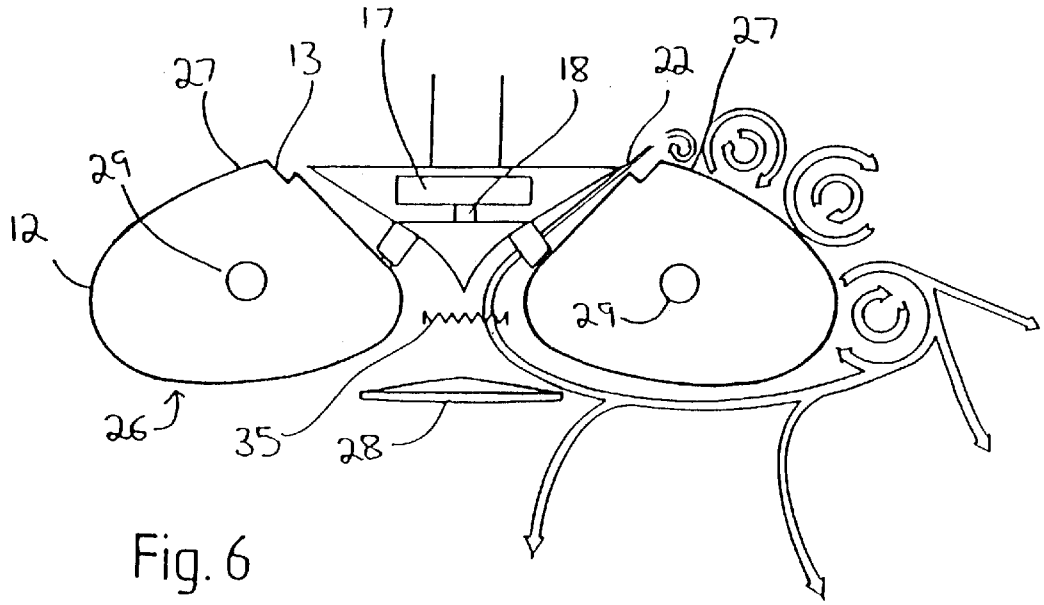
FIG. 6 is a side section view of an air movement apparatus.

Referring to FIGS. 5 and 6, as the ring vortices move along upper surface 25, ambient air is entrained within the vortices. Ambient air will be sucked and entrained into the vortices not only immediately above blowing slot 22 but also entirely along lower pressure surface 25. Once the vortices pass rim 14, the pressure increases and air is ejected downwardly. However, adjacent the rim portion, air may be ejected and may curve upwardly back into the ring vortices on lower pressure surface 25 which can result in an unwanted feedback loop.

To minimise this occurence, a shroud 32 can be provided. Shroud 32 is in the form of an annular band which may be formed from metal or plastic and which extends about body 10 at the rim portion 12. Shroud 32 is spaced away from body 10 by a distance approximately the size of a ring vortex passing rim 12. Shroud 32 minimises air looping back from immediately below rim 12 to immediately above rim 12.

If the apparatus is mounted in a wall or ceiling opening, the walls of the opening may themselves form shroud 32 and therefore a separate shroud may not be necessary.

The apparatus may be attached to a pair of opposed pins to allow it to be swung around by 180°. In this arrangement, the apparatus could be mounted in a wall and could either function as an air blower, or turned 180° to function as an air exhaust.

Struts and other means of holding the various parts together can be provided and the struts have been omitted for the sake of clarity. The fan 14 can be multi-staged to increase jet discharge speeds if required.

FIGS. 5 and 6 show a fan 14 which ejects air substantially at 45° and the step 13 facilitates bending and tubulating of the air. If blowing slot 22 is substantially horizontal relative to the portion of body 10 immediately next to blowing slot 22, and if a centrifugal fan is provided, the air may be sufficiently turbulent to form the vortexes without requiring step 13.

It should be appreciated that various other changes and modifications may be made to the embodiment described without departing from the spirit and scope of the invention.

What is claimed is:

1. An air movement apparatus comprising a curved body about which air can circulate, the curved body having a rim and, in use, having a lower pressure surface on one side of the rim, and a higher pressure surface on the other side of the rim, an air outlet to blow air over the lower pressure surface, an air inlet to suck air in from the higher pressure surface, and air acceleration means to move air from the air inlet to the air outlet, and the curved body is surrounded by a housing.

2. The apparatus of claim 1, wherein the body is a toroid.

3. The apparatus of claim 2, wherein the air acceleration means is in the central passageway defined by the toroid.

4. The apparatus of claim 3, wherein the air outlet is an annular opening adjacent one end of the central passageway, and the air inlet is adjacent the other end of the central passageway.

5. The apparatus of claim 4 including a first barrier member positioned adjacent the said one end of the central passageway, the barrier member having a peripheral edge spaced from the body to define the annular opening of the air outlet.

6. The apparatus of claim 5, wherein the first barrier member has a portion extending into the central passageway.

7. The apparatus of claim 6, wherein the air acceleration means is a fan which is supported by the said portion.

8. An air movement apparatus comprising a curved body about which air can circulate, the curved body having a rim and a central passage way and, in use, having a lower pressure surface on the one side of the rim, and a higher pressure surface on the other side of the rim, an air outlet to blow air over the lower pressure surface, an air inlet to suck air in from the higher pressure surface, and air acceleration means to move air from the air inlet to the air outlet.

a first barrier member positioned adjacent the said one end of the central passageway, the barrier member having a peripheral edge spaced from the body to define the annular opening of the air outlet wherein an first barrier member is slidably attached to a shaft, and the curved body surrounded by a housing.

9. The apparatus of claim 5 including a second barrier member spaced adjacent the other end of the central passageway, the second barrier member being spaced from the body to define the air inlet.

10. The apparatus of claim 7, wherein a recess is provided in the body and adjacent the air outlet to entrain and evacuate the air under apparatus.

11. The apparatus of claim 1, wherein an annular recess is formed in the upper side of the curved body to promote the forming of vortices.

12. An air movement apparatus comprising a curved body about which air can circulate, the curved body having a rim and a central passageway and, in use, having a lower pressure surface on one side of the rim, and a higher pressure surface on the other side of the rim, an air outlet to blow air over the lower pressure surface, an air inlet to suck air in from the higher pressure surface, and air acceleration means to move air from the air inlet to the air outlet;

including a first barrier member positioned adjacent one end of the central passageway, the barrier member having a peripheral edge spaced from the body to define the annular opening of the air outlet, the peripheral edge spaced inwardly of the curved body high point.

* * * * *